United States Patent [19]

Scharch

[11] Patent Number: 5,052,549

[45] Date of Patent: Oct. 1, 1991

[54] TRAY FOR AMMUNITION CARTRIDGES

[76] Inventor: Daniel J. Scharch, 6589 County Rd. 105, Salida, Colo. 81201

[21] Appl. No.: 661,891

[22] Filed: Feb. 27, 1991

[51] Int. Cl.[5] ..... F42B 39/00

[52] U.S. Cl. ..... 206/3; 86/47

[58] Field of Search ..... 206/3; 86/47

[56] References Cited

U.S. PATENT DOCUMENTS

| | | | |
|---|---|---|---|
| 2,389,285 | 11/1945 | Vergobbi | 86/47 |
| 3,153,500 | 10/1964 | Pachmayr et al. | 206/3 |
| 4,257,520 | 3/1981 | Hohmann et al. | 206/3 |
| 4,811,836 | 3/1989 | Minneman | 206/3 |

*Primary Examiner*—William I. Price

*Attorney, Agent, or Firm*—Dorr, Carson, Sloan & Peterson

[57] ABSTRACT

A one-piece, injection molded plastic tray for packaging ammunition cartridges of various sizes. Symmetrically arranged cylinders are formed in the tray opening into the upper surface to hold the cartridges.

The lower end portions of the cylinders terminate in a hole having a diameter smaller than the inside diameter of the upper portion of the cylinders and concentric therewith to form a ledge. The diameter of the upper portions of the cylinders is large enough for various sizes of ammunition to pass through. The diameter of the lower end of the cylinders is large enough for the nose end of the cartridgtes to pass through while the ledges prevent the tapered surface of the nose end of the cartridges from passing entirely through. The nose ends of the cartridges are held above the plane of the bottom of the side walls of the tray by at least one-sixteenth inch.

Cross ribs are formed between adjacent cylinders and side walls to provide additional rigidity to the tray. Recyclable materials may be used and the trays are durable enough to be reused.

17 Claims, 3 Drawing Sheets

Fig. 3
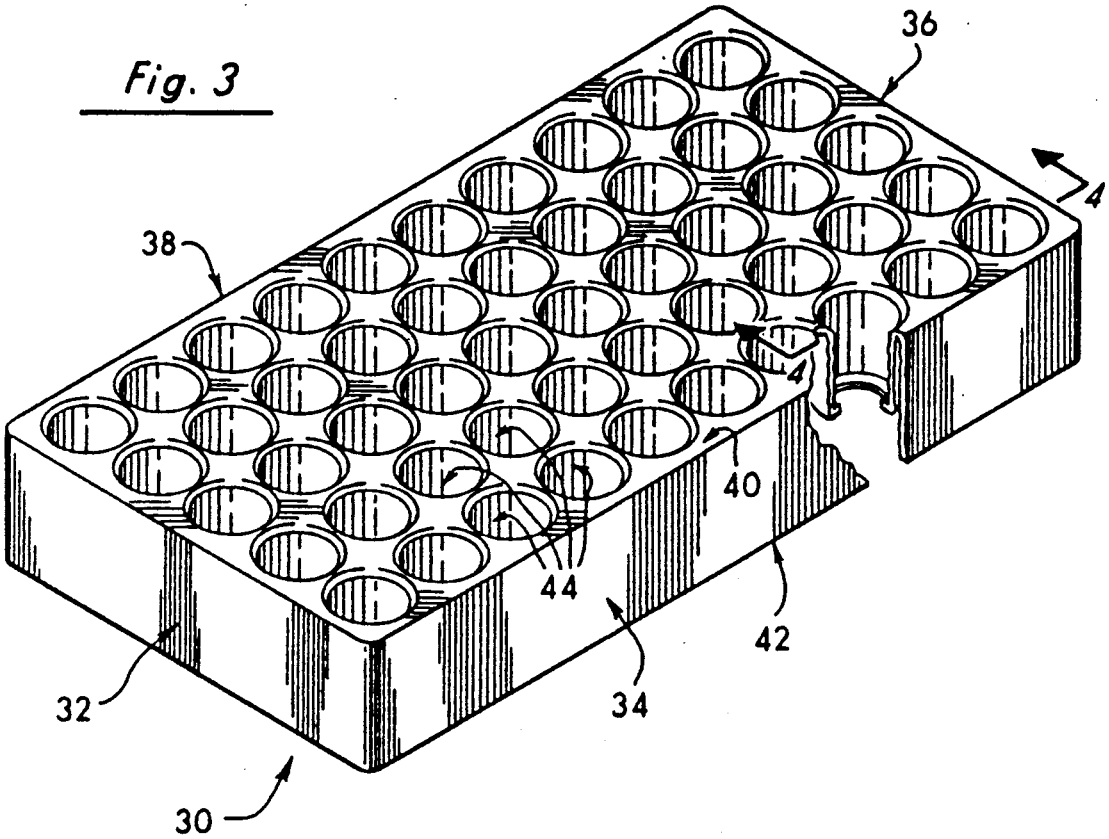
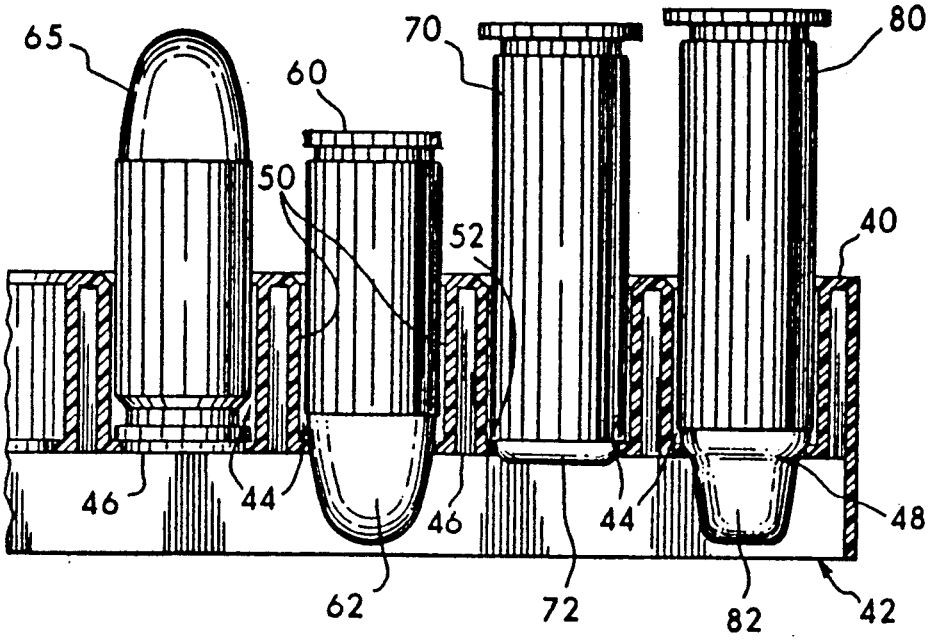
Fig. 4

TRAY FOR AMMUNITION CARTRIDGES

BACKGROUND OF THE INVENTION

1. Field of the invention:

This invention relates to the field of trays for packaging ammunition cartridges.

2. Statement of the Problem:

Ammunition cartridges are typically packaged in one of three methods. One procedure packs the cartridges in styrofoam trays which are formed through traditional styrofoam forming techniques. These trays have the advantages of being lightweight, with relatively inexpensive tray molds. The disadvantages of the styrofoam trays are the long manufacturing cycle times, the inability to recycle scrap that is generated in the manufacturing process, the ease in which styrofoam is chipped, crushed, or soiled, the inability to reuse the majority of the trays directly for their original use, and the environmental problem associated with the disposal of the styrofoam tray.

A second procedure uses plastic molded trays, such as the trays used by FEDERAL CARTRIDGE COMPANY, Minneapolis, Minn. which are produced by CHAMPION TARGET COMPANY, 232 Industrial Parkway, Richmond, Ind. These trays do not have the material and manufacturing disadvantages as the above described styrofoam trays. However, these trays require a complicated molding process which increases the costs of production, have a heavier weight which increases shipping and packaging costs, and are not suited for use in any of the rifle calibers presently sold.

The third technique of packaging ammunition cartridges is by loose packing, that is packaging the ammunition cartridges in boxes without trays. This method of packaging does reduce packaging supply costs but does not keep tray packing costs down.

There presently exists a need for an ammunition tray for packaging ammunition cartridges that is lightweight, having a high strength to weight ratio, inexpensive to manufacture, and is usable with a variety of ammunition cartridges.

3. Solution to the Problem:

The present invention solves these and other problems by providing an ammunition tray formed by injection-molded plastic.

The present invention provides a lightweight tray having a high weight to strength ratio.

The present invention provides a tray having a rigid structure.

The present invention provides a tray usable with a variety of sizes of ammunition cartridges including rifle ammunition.

The present invention provides a tray capable of being reused.

The present invention provides a tray formed from recyclable plastic material.

These and other features will become evident from the following description taken in conjunction with the drawings.

SUMMARY OF THE INVENTION

The present invention provides a tray for packaging ammunition cartridges of various sizes. The tray is formed in one piece by injection molding. The tray includes an upper planar surface with four side walls extending downward in a rectangular shape. Symmetrically arranged cylinders are formed in the tray opening into the upper surface to hold the cartridges.

The cylinders extend downward to terminate in a plane extending parallel to and spaced above a plane containing the bottoms of the side walls. The lower end portions of the cylinders terminate in a hole having a diameter smaller than the inside diameter of the upper portion of the cylinders and concentric therewith. The smaller diameter hole forms a ledge. The diameter of the upper portions of the cylinders is large enough for various sizes of ammunition to pass through. The diameter of the lower end of the cylinders is large enough for the nose end of the cartridges to pass through while the ledges prevent the tapered surface of the nose end of the cartridges from passing entirely through. The nose ends of the cartridges are held above the plane of the bottom of the side walls of the tray by at least one-sixteenth inch.

Cross ribs are formed between adjacent cylinders and side walls to provide additional rigidity to the tray. The entire tray is formed by injection molding without the need for cross-coring or other complicated processes. Recyclable materials may be used and the trays are durable so to be reused. The tray of the present invention has a weight of approximately eight-tenths ounce. The tray has a relatively high strength to weight ratio as compared to prior plastic trays.

The cost, weight and environmental savings become significant when the enormous number of trays used in the munitions industry is considered. The ability of the trays to hold a variety of calibers and sizes of ammunition enables a munitions packager to reduce the inventory of differing types of trays required for packaging various types of ammunition. These and other features will become evident in the ensuing discussion of a preferred embodiment taken in conjunction with the drawings.

BRIEF DESCRIPTION OF THE DRAWINGS

FIG. 3 is a perspective view of one possible preferred embodiment of the present invention for packaging pistol or rifle ammunition.

FIG. 4 is a view of FIG. 3 along line 4—4 for packaging pistol ammunition.

DETAILED DESCRIPTION OF A PREFERRED EMBODIMENT

Ammunition cartridges have been previously packaged in a variety of ways. One procedure is simply loose packing the ammunition cartridges into boxes. This is normally done with rifle ammunition as well as other caliber and types of ammunition. The cartridges are packed in the cartridges boxes in a loose form without the use of trays. This procedure creates difficulty in handling the loose cartridges during packaging and removal of the cartridges from the box and in handling partially filled boxes.

Figure 1:
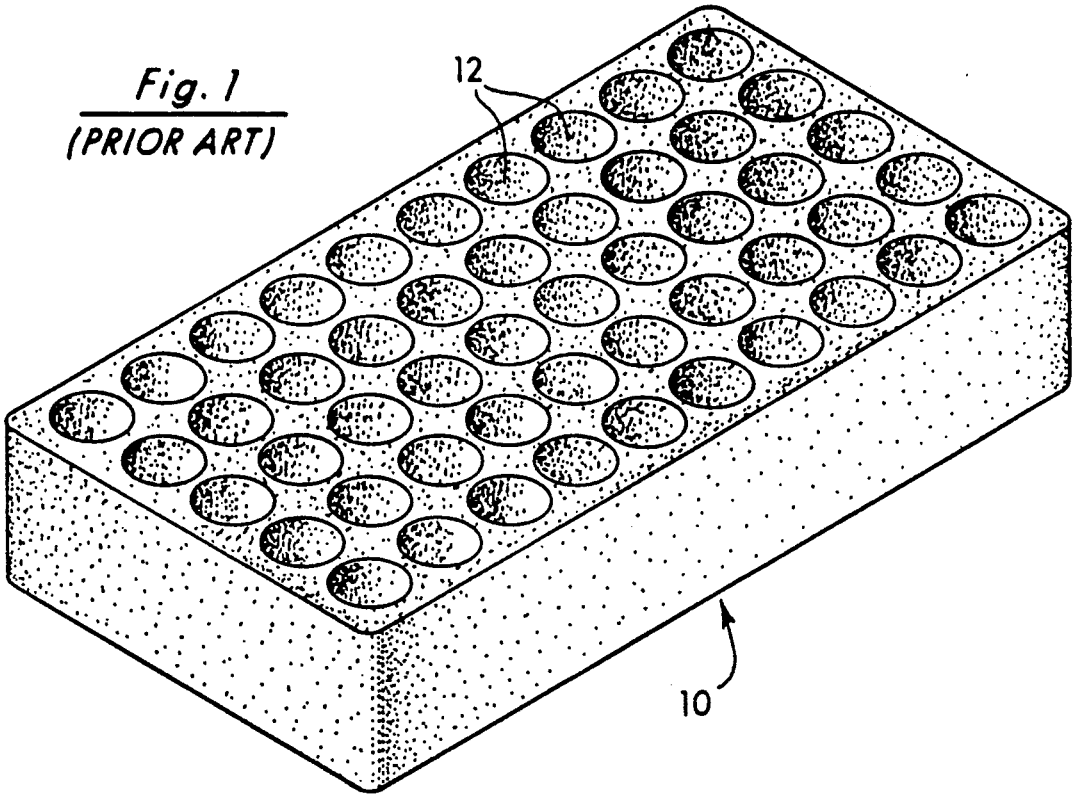
Fig. 1 (PRIOR ART)
FIG. 1 is a perspective view of a prior art styrofoam cartridge tray.

It is therefore desirable to load the cartridges in trays which are then packaged into boxes. This provides greater ease in packaging as well as handling partially filled boxes. One such tray is illustrated in FIG. 1. Tray 10 is formed of styrofoam by well-known styrofoam forming techniques. Tray 10 provides a lightweight, relatively inexpensive tray. However, styrofoam trays are environmentally destructive due to the inability to recycle styrofoam and the lack of degradation when disposed. Cartridges are loaded into holes 12 formed in tray 10 nose end first until the nose ends of the cartridges abut the bottom of holes 12. Different designs and sizes of trays are necessary for various sizes of ammunition cartridges.

Figure 2:
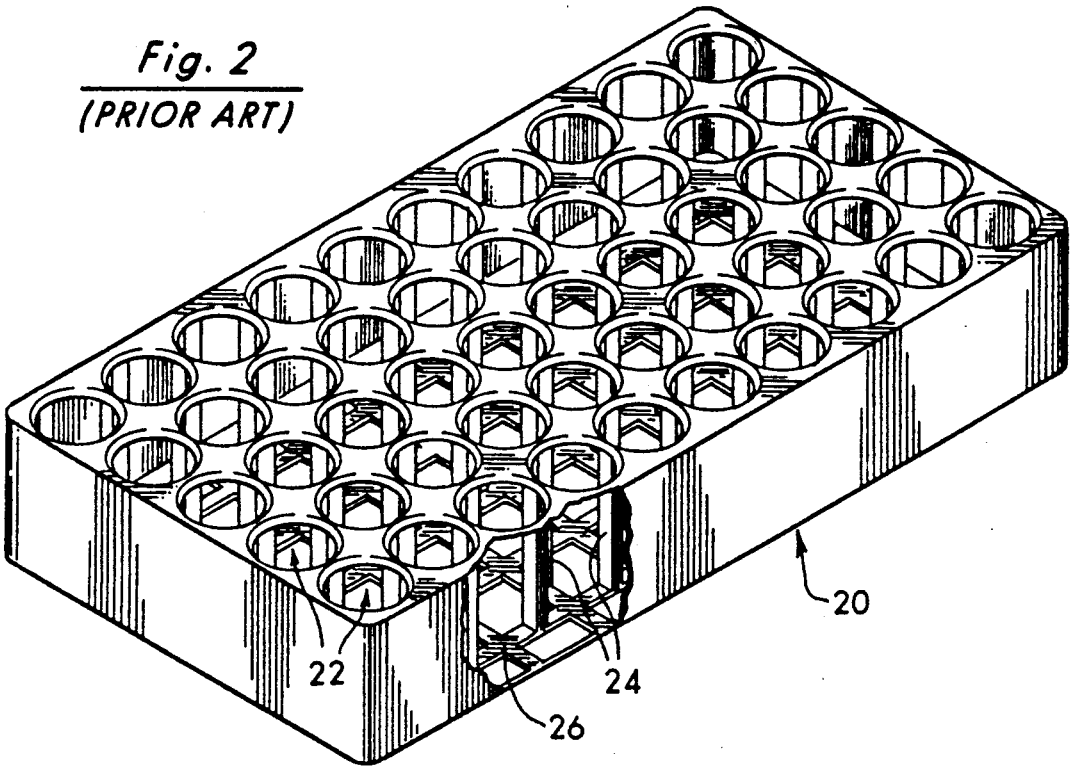
Fig. 2 (PRIOR ART)
FIG. 2 is a perspective view of a prior art molded plastic tray.

Molded plastic tray 20, shown in FIG. 2, is another prior art tray used for packaging ammunition cartridges. Tray 20 is formed having a hollow interior with holes 22 formed in the upper surface. Support portions 24 extend downward from holes 22 and are spaced about each side of holes 24 to provide rigidity to the tray and lateral support to cartridges loaded in tray 20. Bottom rib portions 26 extend in a grid array on the bottom side of tray 20. Bottom rib portions 26 are formed so intersections of bottom rib portions 26 are centered beneath each hole 22. Cartridges loaded into holes 22 of tray 20 abut these intersections to retain the cartridges in tray 20. Trays 20 require a complicated molding process due to the rib portions 24 and 26 which increases the expense of the trays. These trays have a relatively heavy weight, typically about 1.2 ounces. Trays 20 also require different designs and sizes to package various sizes of ammunition.

Figure 5:
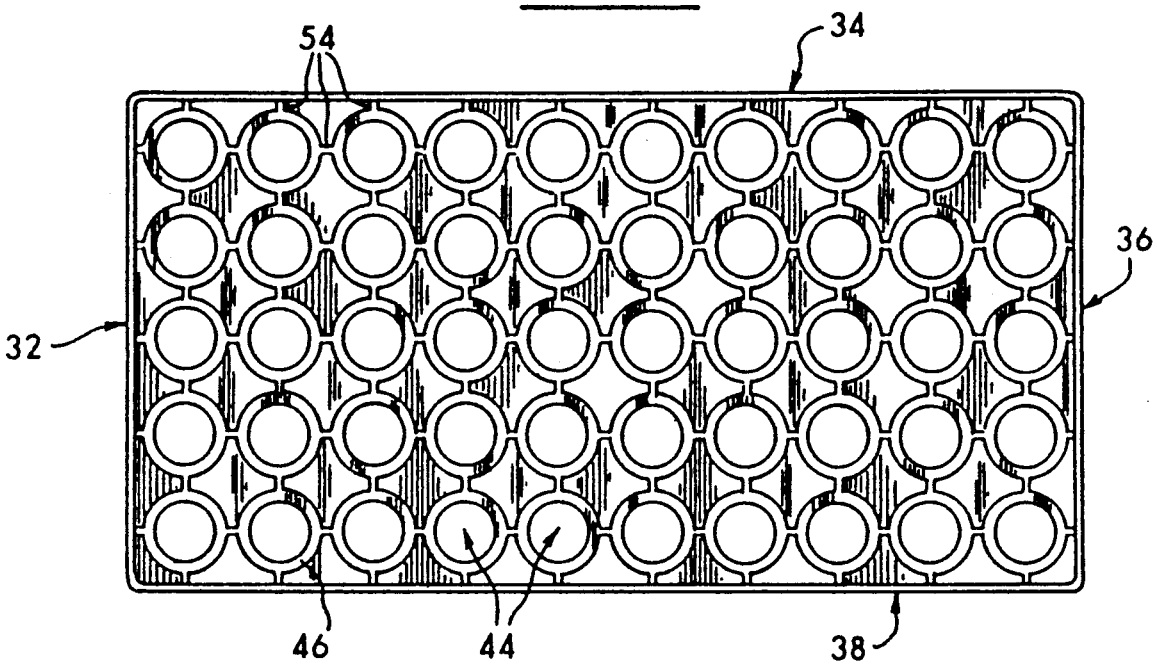
FIG. 5 is bottom view of the embodiment of FIG. 3 for packaging pistol ammunition.

One possible preferred embodiment of the present invention is illustrated in FIGS. 3–5. This descriptive embodiment is for explanatory purposes and is not meant to limit the scope of the claimed invention. Other variations and designs are considered to be within the scope of the invention as claimed.

Tray 30 is formed in a substantially rectangular shape by injection molding techniques. Tray 30 includes upper planar surface 40 with side walls 32, 34, 36, 38 extending perpendicularly downward therefrom. Sidewalls 32, 34, 36, 38 terminate in planar surface 42 which is parallel to upper planar surface 40. A plurality of symmetrically arranged cylindrical tubular portions 44 open into upper surface 40. Tubular portions 44 extend downward from upper surface 40 and terminate in lower end portions 46. Lower end portions 46 lie in plane 48 parallel to plane 42 and spaced above plane 42 by a predetermined distance. The predetermined distance is chosen according to the various sizes of ammunition cartridges to be loaded in tray 30 as discussed below. In one embodiment illustrated in FIG. 4, for packaging nine millimeter Luger cartridges, 38 Special double end wad cutter cartridges, 38 Special semi wad cutter cartridges, and others, this distance is 0.25 inches. The invention is not meant to be limited by these calibers and types of ammunition but extends to all feasible calibers and types.

Upper portion 50 of tubular portions 44 has an inner diameter sufficient for various sizes of ammunition to be inserted therein. The opening of upper portion 50 extending into upper surface 40 is beveled to provide greater ease in loading the cartridges into tubular portions 44.

Lower portions 46 of tubular portion 44 include an inner diameter less than the inner diameter of upper portion 50 and concentric therewith. Ledge 52 is formed from the smaller inner diameter of lower portion 46. The inner diameter of lower portion is chosen to be less than the outer diameter of the cartridges loaded into the tray and less than the outer diameter of the forward nose portion of the cartridges as illustrated in FIG. 4. This allows the cartridges to be loaded into tray 30 nose portion first with the nose portions extending partly through lower end portion 46. The predetermined distance between plane 48 and plane 42 holds the nose of the cartridges above plane 42 to allow the cartridges to be fully inserted into tray 30.

Cross ribs 54 are formed between each of the tubular portions 44 and the adjacent tubular portion 44 or side wall 32, 34, 36, 38 as shown in FIG. 5. Cross ribs 54 provide additional strength and rigidity to tray 30 without adding greatly to the weight of the tray or complicating the tray molding process.

Cartridges are loaded into trays 30 by insertion into holes 44 in the upper planar surface 40. For example, cartridges 60, 70, 80 are loaded nose ends 62, 72, 82 first as illustrated in FIG. 4. The nose ends 62, 72, 82 of cartridges 60, 70, 80 pass through lower end holes 44 until the tapered surface of the nose end engages ledge 52 to hold the nose end of the cartridge above the plane of the bottom surface of the tray. Typically, the nose end is held at least one-sixteenth inch above the bottom surface plane. This allows loaded trays 30 to be stacked on top of one another.

Trays 30 are designed to package various sizes of ammunition with a single size of trays. For instance, tray 30 illustrated in FIG. 4 can hold a nine millimeter Luger bullet 60, a .38 Special double wad cutter bullet 70 and a .38 Special simi wad cutter bullet 80 with the respective nose ends 62, 72, 82 of the bullets 60, 70, 80 above the bottom surface plane. This allows a munitions packager to reduce the variety of differing sizes of trays necessary to package a variety of ammunition as well as provide more uniformity in the packaging processes.

Cartridges are loaded into trays 30 nose end down. Cartridges which have been loaded upside down such as cartridge 65 illustrated in FIG. 4 or cartridges of the wrong caliber can be located and replaced. The cartridges are thus uniformly aligned and can be easily inspected for misaligned cartridges. The misaligned cartridges can be quickly culled out and replaced because the bullet end is substantially higher than the cartridges which are properly oriented.

Figure 6:
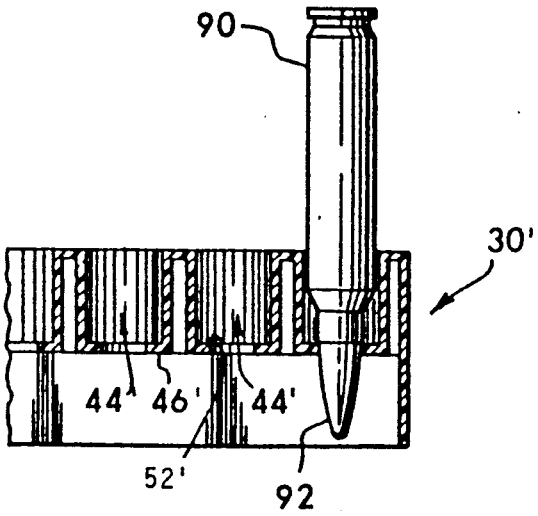
FIG. 6 is a view of FIG. 3 along line 4—4 for packaging rifle ammunition.

The present invention also provides a tray usable for packaging rifle ammunition. This had proved difficult with prior trays. As illustrated in FIG. 6, a rifle cartridge, such as .223 caliber, is inserted into tray 30′ of the present invention noes end 92 down. Tray 30′ is similar to previously described tray 30 except the bottom plane 46 of the bottom end of the tubular portions is spaced a greater distance from the bottom plane 42 of tray 30′ to prevent nose end 92 from penetrating plane 42. The use of ledges 52 to hold the cartridges enables trays 30′ to hold the rifle cartridges.

Trays 30 are formed from injection molding by a relatively simple process. This reduces the cost of manufacturing the trays. The design of trays 30 of the present invention provide a tray having significantly less weight as compared to the prior art plastic trays. Tray 30 has a weight approximately 0.85 (eighty-five hundredths) ounce. This is 30 per cent lighter than the prior plastic trays. The cross-ribs 54 increase the rigidity of trays 30 providing a favorable strength to weight ratio.

The ammunition cartridge trays of the present invention provide a lightweight, inexpensive tray having a relatively high strength to weight ratio capable of packaging various sizes of ammunition. The trays of the present invention can decrease the need to inventory a variety of sizes and designs of trays for various calibers and types of ammunition. The trays may be formed from recyclable plastics and are reusable. The enormous numbers of trays required by the munitions industry can result in considerable savings in weight, expense and damage to the environment with the use of the tray of the present invention.

The invention as claimed is not meant to be limited by the description of the preferred embodiment. Other variations are considered to be within the scope of the inventive concept.

I claim:

1. A tray for packaging ammunition cartridges, said tray comprising:

a tray having a thin planar upper surface, and thin side walls extending downward from said upper surface;

said side walls terminating in a first plane parallel to said upper surface;

a plurality of tubular portions formed in said tray extending downward from said upper surface;

each tubular portion including a cylindrical opening extending downward from said upper surface the full length of said tubular portions for receiving cartridges;

each of said cylindrical openings having an upper portion opening into said upper surface and having an inner diameter adapted to receive said cartridges;

each of said tubular portion having a lower end which is contained in a second plane parallel to said first plane and spaced above said first plane by a predetermined distance; and means formed in said tubular portions for holding the nose end of said cartridges above said first plane.

2. The tray of claim 1 wherein said holding means include a lower portion formed in each of said lower ends concentric with said upper portion of each cylindrical opening and having an inner diameter smaller than the inner diameter of said upper portions to form a ledge to prevent said cartridges from passing entirely through said lower ends.

3. The tray of claim 2 wherein said predetermined distance is chosen to hold the nose ends of said cartridges above said first plane.

4. The tray of claim wherein said tray includes rib portions formed between and attached to adjacent tubular portions and adjacent side walls to add rigidity to said tray.

5. The tray of claim 1 wherein said tray is formed by injection molding.

6. The tray of claim 1 wherein said tray weighs less than 0.85 (eighty-five hundredths) of an ounce.

7. The tray of claim 1 wherein said tray is formed from recycled plastic materials.

8. The tray of claim 2 wherein said upper portions are formed with an inside diameter large enough for a variety of differing size ammunition to fit within said upper portions and said lower portions of said lower ends include a diameter sufficient to allow the forward portion of said nose ends of said cartridges to pass through while preventing said cartridges from passing entirely through.

9. A tray for packaging ammunition cartridges, said tray comprising:

a lightweight, one-piece tray having a thin planar upper surface, and thin side walls extending downward from said upper surface;

said side walls terminating in a plane parallel to said upper surface;

a plurality of tubular portions formed in said tray;

each tubular portion including a cylindrical opening extending downward from said upper surface the full length of said tubular portions for receiving cartridges;

each of said cylindrical openings having an upper portion opening into said upper surface and having an inner diameter adapted to receive said cartridges;

each of said tubular portion having a lower end which is contained in a second plane parallel to said first plane and spaced above said first plane by a predetermined distance; and a lower portion formed in each of said lower ends concentric with said upper portion of each cylindrical opening and having an inner diameter smaller than the inner diameter of said upper portions to form a ledge to prevent said cartridges from passing entirely through said lower ends.

10. The tray of claim 9 wherein said predetermined distance is chosen to hold said nose portions of said cartridges above said first plane.

11. The tray of claim 10 wherein said tray includes cross ribs formed between and attached to adjacent cylindrical portions and adjacent side walls to provide rigidity to said tray.

12. The tray of claim 11 wherein said first portions are formed with an inside diameter large enough for a variety of differing size ammunition to fit within said first portions and said second portion of said lower end includes a diameter sufficient to allow the forward portions of said cartridges to pass through while preventing the end portions of said cartridges from passing through.

13. The tray of claim 12 wherein said trays are formed in a rectangular shape by injection molding.

14. The tray of claim 13 wherein said trays have a weight of 0.85 (eighty-five hundredths) of an ounce or less.

15. A method of packaging ammunition cartridges, said method comprising the steps of:

forming a tray having an upper planar surface and thin side walls extending downward from said upper surface and terminating in a first plane parallel to said upper surface;

forming tubular cylindrical portions for receiving said cartridges opening into and extending from said upper surface and terminating in a lower end portion lying in a second plane parallel to and spaced above said first plane;

forming a concentric portion having a smaller diameter than the upper cylindrical portion forming a ledge therein; and placing cartridges into said cylindrical portions nose end first so that said nose ends pass partly through said concentric portion.

16. The method of claim 15 wherein said method further comprises the steps of:

checking said tray for upside down cartridges; and reversing any upside down cartridges.

17. The method of claim 15 wherein said method further comprises the steps of:

checking said tray for any defective cartridges; and removing and replacing any defective cartridges.

* * * * *